US007143846B2

(12) United States Patent
Järvelä et al.

(10) Patent No.: US 7,143,846 B2
(45) Date of Patent: Dec. 5, 2006

(54) METHOD FOR DRILLING AND DRILLING APPARATUS TO ENABLE REVERSE CIRCULATION

(75) Inventors: Jorma Järvelä, Tampere (FI); Vesa Järvelä, Espoo (FI)

(73) Assignee: OY Atlas Copco Rotex AB, Tampere (FI)

( * ) Notice: Subject to any disclaimer, the term of this patent is extended or adjusted under 35 U.S.C. 154(b) by 0 days.

(21) Appl. No.: 10/471,145

(22) PCT Filed: Feb. 18, 2002

(86) PCT No.: PCT/FI02/00130

§ 371 (c)(1),
(2), (4) Date: Oct. 3, 2003

(87) PCT Pub. No.: WO02/081856

PCT Pub. Date: Oct. 17, 2002

(65) Prior Publication Data

US 2004/0104050 A1 Jun. 3, 2004

(30) Foreign Application Priority Data

Apr. 4, 2001 (FI) ..... 20010699

(51) Int. Cl.
*E21B 10/38* (2006.01)
*E21B 7/20* (2006.01)

(52) U.S. Cl. ..... 175/257; 175/171; 175/215; 175/417

(58) Field of Classification Search ..... 175/213, 175/215, 324, 400, 417, 418, 171, 257
See application file for complete search history.

(56) References Cited

U.S. PATENT DOCUMENTS 3,382,934 A * 5/1968 Spear ..... 175/171

(Continued)

FOREIGN PATENT DOCUMENTS

FI 95618 11/1995

(Continued)

*Primary Examiner*—David Bagnell
*Assistant Examiner*—G M Collins
(74) *Attorney, Agent, or Firm*—Venable LLP; Eric J. Franklin

(57) ABSTRACT

The invention relates to a method for drilling, being carried out by a drilling apparatus, having a drilling device (1) that comprises a casing part (2) and a drilling unit (3), in the drilling head (I) of which there are first drilling means (4) for drilling a center hole and second drilling means (5) for reaming of the center hole for the casing part (2) as well as flushing flow arrangement (6) for flushing of waste, being generated. At least during the drilling situation, the first drilling means (4) are coupled by a power transmitting and, in order to enable removal of the same from the hole, removable arrangement, such as a bayonet coupling or like, with the second drilling means (5). A feed flow (6*a*) of flushing medium, being carried out centrally, is being transferred by internal drillings (X1) inside a first frame part (4*a*), belonging to the first drilling means (4), to its outer periphery and a return flow (6*b*) of flushing medium, in order to accomplish a so called reverse circulation of flushing medium, from the drilling surface (pp2) of the first frame part (4*a*) through internal drillings (X2) therein into a space (z) between the first frame part (4*a*) and the casing part (2). The invention relates also to a drilling apparatus for exploitation of the method described above.

16 Claims, 3 Drawing Sheets

U.S. PATENT DOCUMENTS

| | | | | | |
|---|---|---|---|---|---|
| 4,223,747 | A * | 9/1980 | Marais | 175/65 | |
| 4,765,416 | A * | 8/1988 | Bjerking et al. | 175/71 | |
| 5,154,244 | A | 10/1992 | Elsby et al. | | |
| 5,407,021 | A | 4/1995 | Kane et al. | | |

FOREIGN PATENT DOCUMENTS

| | | |
|---|---|---|
| FR | 2324856 | 4/1977 |
| WO | WO 94/12760 | 6/1994 |

* cited by examiner

METHOD FOR DRILLING AND DRILLING APPARATUS TO ENABLE REVERSE CIRCULATION

FIELD OF THE INVENTION

The invention relates to a method that is meant particularly for increasing the efficiency of earth drilling.

BACKGROUND OF THE INVENTION

A way to carry out earth drilling in a more developed manner compared to prior art, is formerly known e.g. from Finnish Patent No. 95618. The drilling head of the drilling unit of the drilling apparatus, being exploited in this connection, is formed as shown in FIG. 1 of a first frame part and a second frame part, in the drilling surfaces of which there has been arranged drilling organs, such as drill bits or like, of the first and second drilling means or in other words of the pilot and the reamer. In the solution in question the second organs of the flushing means for removal of drilling waste, being generated, are arranged to lead drilling waste by means of an assembly belonging to the counterpart surface arrangement, which connects the said drilling means together for a drilling situation unrotatively in respect with each other and in both directions longitudinally, which, in other words, is being carried out as an advantageous embodiment by loosening grooves, belonging to a bayonet coupling, placed longitudinally in the outer periphery of the first frame part.

The solution in question has got very good feedback from professionals in the art and a very big market share both domestically and abroad. The good success of the solution in question is based on the totally new construction in its time, which enables transmitting of flushing medium to the drilling surface and removing of same therefrom advantageously in a way that does not weaken other structures of the drilling apparatus in any way.

On the other hand particularly in sampling drilling, the meaning of undisturbed and homogeneous return flow of drilling waste, or of the sampling material to be collected, is considered very important. In this connection in those sampling drills usually being used before, there has been used a so called reverse flow or reverse circulation (RC-principle), in which connection on the principle being shown e.g. in FIG. 2, both feeding of the flushing medium and its return flow are led in a flow assembly, being placed at the center of the drilling device, from which flushing medium is being led furthermore in radial direction to the drilling surface and into which it is finally being returned by means of return flow assemblies, being placed in the radial direction at the drilling end of the drilling device. By leading the return flow in this way from the outer periphery of the bit to the return flow channel, placed at its center, it is possible to improve decisively the quality of sampling particularly in the above purpose.

The solution according to Finnish Patent No. 95618 is very efficient in practice, though particularly in those structures that are related to traditional sampling drilling, when the exhaust flow channel of drilling waste is formed according to traditional practice of the space between the center part of the drill and the casing part, the solution in question has led in certain situations to disproportionately large dimensions of the drill components, in order to enable high enough flow velocity of the return flow and as low as possible volume of flushing medium. The corresponding problem may be faced on other occasions as well, where components are being used in the drilling apparatus that have e.g. dimensions that deviate to some extent from those being standardized.

SUMMARY OF THE INVENTION

The method according to this invention is aimed to achieve a decisive improvement in the problems described above and thus to raise substantially the level of prior art.

As the most important advantages of the method according to the invention, simplicity and operating reliability of its use and of those structures, being enabled by the same, may be mentioned, whereby it is first of all possible to make the dimensions of the drilling apparatus optimally. Thanks to this, e.g. disproportionately massive structures may be avoided, which enables furthermore optimal dimensioning of the drive unit operating the drilling apparatus. Thus the method according to the invention has both direct and undirect effects for improving the efficiency of work and in addition to that in order to decrease manufacturing and operating costs of components belonging to the drilling apparatus.

The invention relates also to a drilling apparatus operating according to the foregoing method. The drilling apparatus according to the invention has been described in greater detail herein.

As the most important advantage of the drilling apparatus according to the invention is the simplicity and operating reliability of the structures enabled by the same as well as of its use, whereby the drilling apparatus according to the invention in its entirety may be optimized under all circumstances in a way most suitable for each embodiment. With the drilling apparatus according to the invention, both traditional drilling and drilling based on reverse flow is enabled only by replacing an ordinary first frame part of the drilling apparatus with a first frame part, being brought about according to the invention and having an internal guiding assembly for the flow of flushing medium.

The drilling apparatus according to the invention is advantageous in such respect also, that in connection with it is possible to use those already existing advantageous drilling apparatus structures, because the modifications required by the invention relate mainly to the drilling head of the drilling unit. Thanks to the invention it is thus possible to carry out drilling with a flushing medium flow that is adequate enough keeping in mind both usual drillings and so called sampling drilling. In connection with the drilling apparatus according to the invention, it is also possible to use other already existing advantageous structures, such as flange arrangements, that are used for drawing the casing part into the hole, or very simple and reliable locking assemblies between the drilling means, such as the bayonet coupling or like.

BRIEF DESCRIPTION OF THE DRAWINGS

In the following description the invention is being described in detail with reference to the enclosed drawings, in which in FIG. 1 is shown a drilling apparatus according to prior art as a longitudinal sectional view, in FIG. 2 is shown a longitudinal sectional view of a drilling apparatus according to prior art, which has been carried out on reverse circulation-principle, in FIG. 3 is shown an advantageous drilling apparatus exploiting the method according to the invention as a longitudinal sectional view.

DETAILED DESCRIPTION OF PREFERRED EMBODIMENTS

Figure 3:
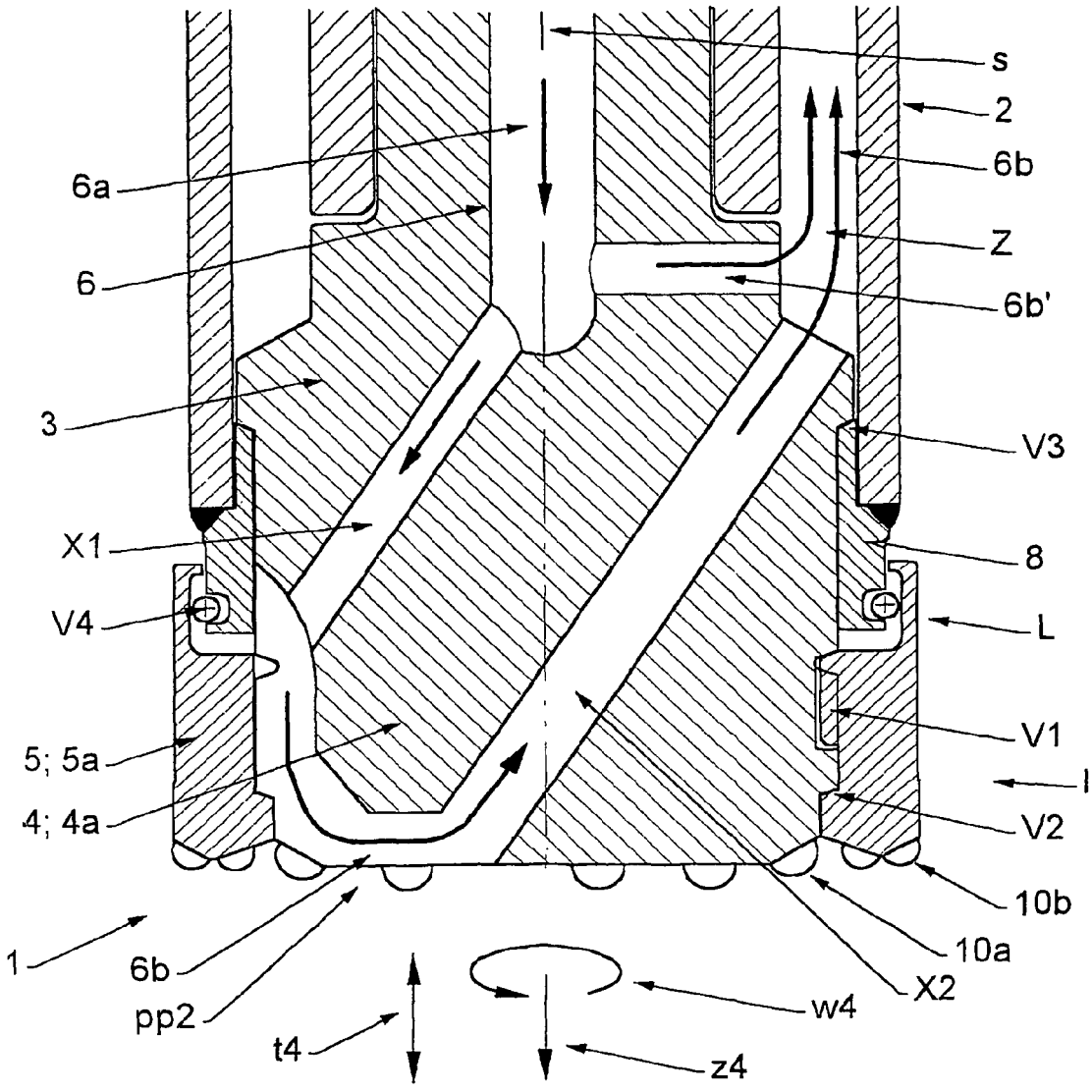

The invention relates to a method for drilling, being carried out by a drilling apparatus, which has, with reference to the advantageous embodiment shown particularly in FIG. 3, a drilling device. 1 that comprises a casing part 2, essentially inside of which there is at least during a drilling situation a drilling unit 3, in the drilling head I of which there are at least first drilling means 4 for drilling a center hole and second drilling means 5 for reaming of the center hole for the casing part 2 as well as flushing flow arrangement 6 for flushing of the waste, being generated, such as for feeding of flushing medium for the drilling and for removal of drilling waste, being generated, essentially inside the casing part 2. At least during the drilling situation, the first drilling means 4 are coupled by a power transmitting and, in order to enable removal of the same from the hole, removable arrangement, such as a bayonet coupling or like, with the second drilling means 5. Furthermore the casing part 2 is arranged to be drawn into the hole to be drilled through the first and/or the second drilling means. A feed flow 6*a* of flushing medium, being carried out centrally, is being transferred by internal drillings X1 inside a first frame part 4*a*, belonging to the first drilling means 4, to its outer periphery, and a return flow 6*b* of flushing medium, in order to accomplish a so called reverse circulation of flushing medium, from the drilling surface pp2 of the first frame part 4*a* through internal drillings X2 therein into a space z between the first frame part 4*a* and the casing part 2.

Figure 1:
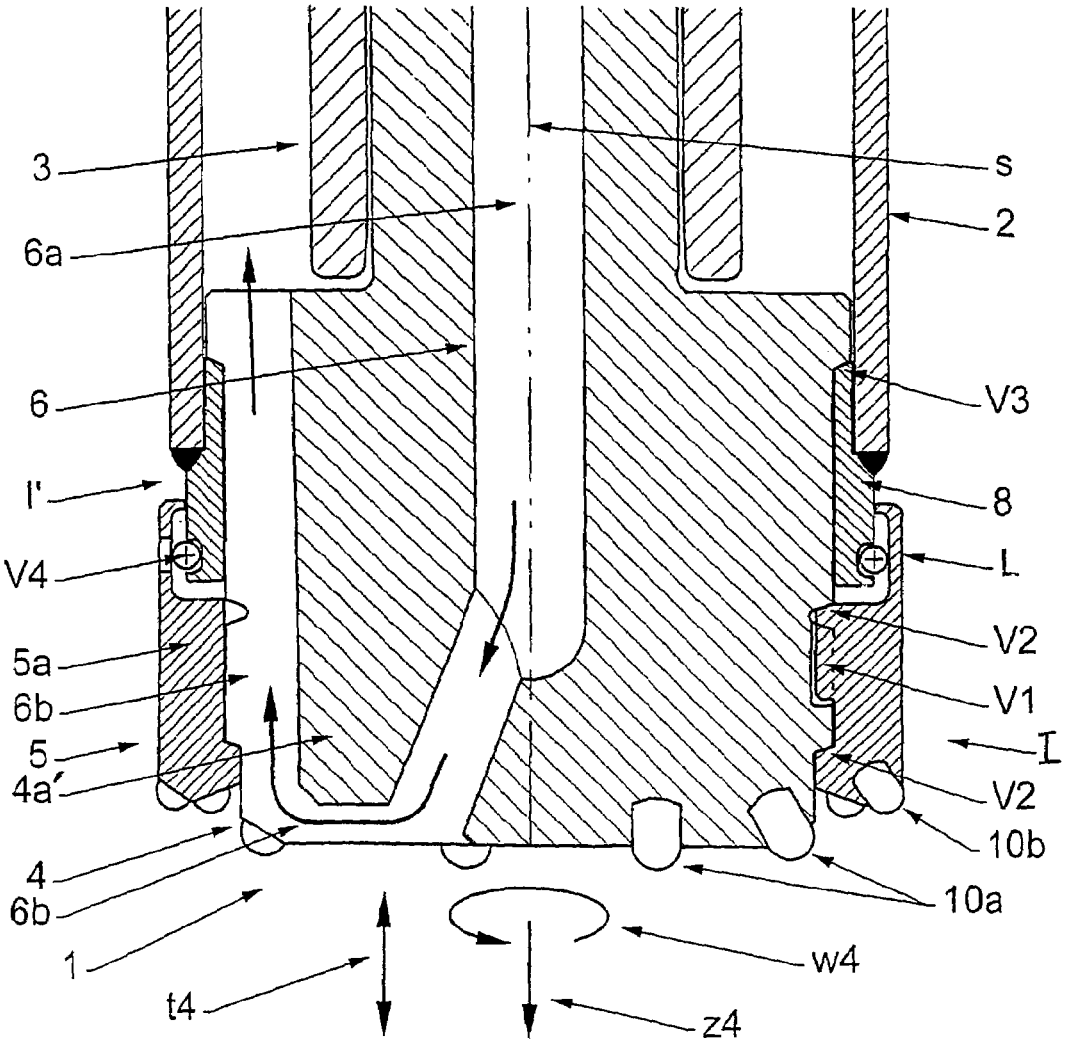
FIG. 1 Prior art

As an advantageous embodiment, the method is being applied e.g. in connection with a drilling apparatus belonging to the prior art as shown e.g. in FIG. 1, in which the drilling head I of the drilling unit 3 of the drilling device 1 is formed of at least a first frame part 4*a*' and a second frame part 5*a*, in the drilling surfaces of which there has been arranged drilling organs 10*a*, 10*b*, such as a uniform cutting part, separate drill bits or parts or like, of the first and the second drilling means 4, 5. Flushing medium is being led in connection with the drilling device 1 at least through the drilling surfaces formed at least of the first and/or the second drilling means, such as inbetween the said frame parts 4*a*', 5*a*, in order to remove flushing medium and drilling waste back to the driving end all the way from the space between the frame part 4*a*' and casing part 2. Instead in the RC-drill shown in FIG. 2, the return flow 6*b* takes place disadvantageously, particularly from the point of view of space usage, through a return pipe, being placed at the center of the frame part 4*a*", in which case the intermediate space, being exploited in the present invention, is left unused. From the point of view of practice, the "double pipe structure" in question is disproportionately difficult also in other respect e.g. from the point of view of the hammering device and the coupling arrangements and structures between the drill pipes.

Furthermore as an advantageous embodiment, the feed flow 6*a* of flushing medium, being brought centrally, is being led on the principle shown in FIG. 3 by a passing flow duct 6*b*' to the space z between the first frame part 4*a* and the casing part 2 particularly in order to adjust the return flow 6*b*, such as sampling flow, that takes place from the drilling surface pp2. As a further advantageous embodiment, the flow occurring in the passing flow duct 6*b*' is being adjusted by exploiting throttle control or in a corresponding manner.

Figure 2:
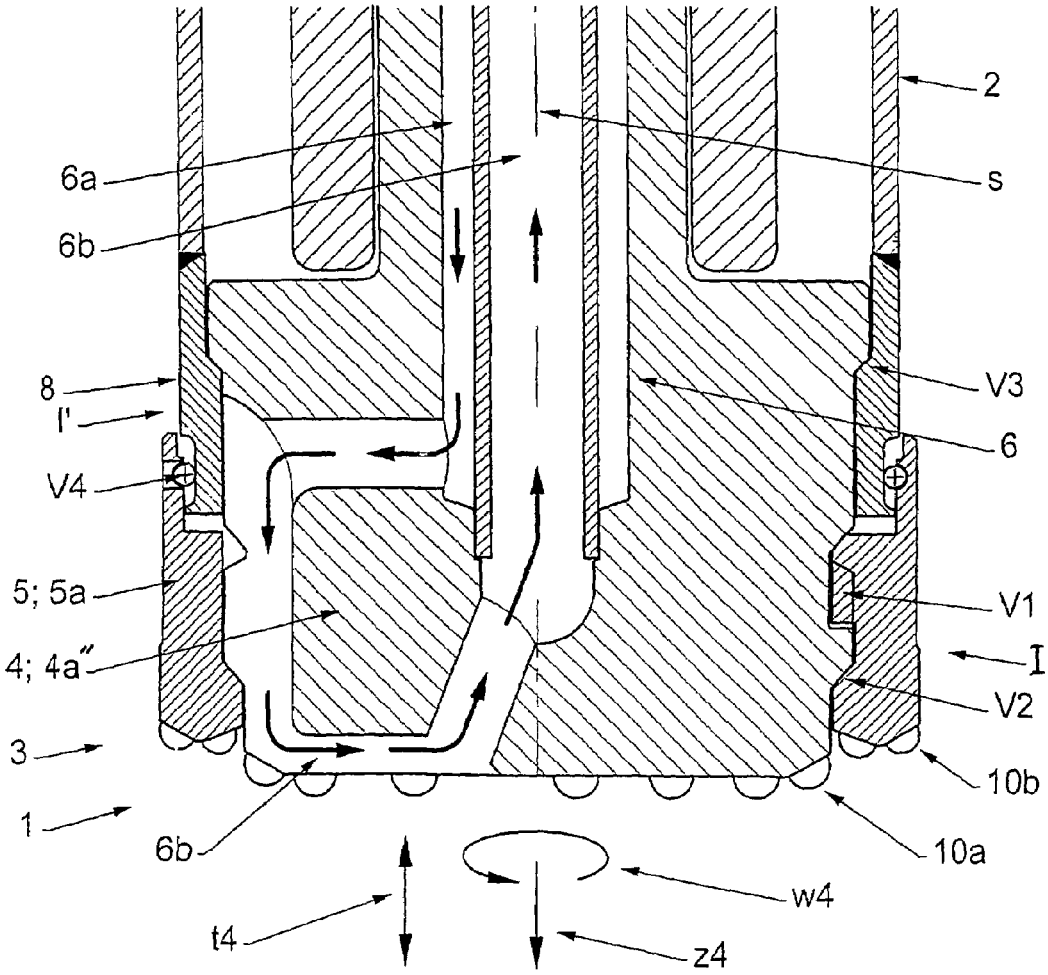
FIG. 2 Prior art

The above depicted method enables use of the same drilling apparatus e.g. as shown in FIG. 1 both in traditional drilling and in drilling carried out on RC-principle e.g. as shown in FIG. 2, only by replacing the ordinary first frame part 4*a*' of the drilling device with a first frame part 4*a*, being carried out according to the invention, which has an internal guiding assembly for the flow of flushing medium, being carried out according to the invention.

The invention relates also to a drilling apparatus having a drilling device 1 that comprises, as shown in FIG. 3, a casing part 2, essentially inside of which there is at least during a drilling situation a drilling unit 3, in the drilling head I of which there are at least first drilling means 4 for drilling a center hole and second drilling means 5 for reaming of the center hole for the casing part 2 as well as flushing flow arrangement 6 for flushing of waste, being generated, such as for feeding of flushing medium for the drilling and for removal of drilling waste, being generated, essentially inside the casing part 2. At least during the drilling situation, the first drilling means 4 are coupled by a power transmitting and, in order to enable removal of the same from the hole, removable arrangement, such as a bayonet coupling or like, with the second drilling means 5. Furthermore the casing part 2 is arranged to be drawn into the hole to be drilled by means of the first and/or of the second drilling means. Inside a first frame part 4*a*, belonging to the first drilling means 4, is arranged a first transferring arrangement X1 in order to transfer a feed flow 6*a* of flushing medium, being carried out centrally, through internal drillings to the outer periphery of the first frame part 4*a*, and a second transferring arrangement X2, in order to accomplish a so called reverse circulation of the flushing medium, by leading a return flow 6*b* through internal drillings from the drilling surface pp2 of the first frame part 4*a* into a space z between the first frame part 4*a* and the casing part 2.

As an advantageous embodiment the feed flow 6*a* of flushing medium, being brought centrally, is led by a passing flow duct 6*b*, to the space z between the first frame part 4*a* and the casing part 2 particularly in order to adjust the return flow 6*b*, such as sampling flow, that takes place from the drilling surface pp2.

The flow occurring in the passing flow duct 6*b*' is adjusted by exploiting throttle control or in a corresponding manner (which has not been shown in greater detail in the drawing in question).

The drilling apparatus, being described above, may thus be used both in an ordinary manner and in drilling based on reverse circulation principle, only by replacing the traditional first frame part 4*a*' of the drilling apparatus with the frame part 4*a*, being brought about according to the invention, which has an internal guiding assembly for the flow of flushing medium.

It is obvious that the invention is not limited to those embodiments, being presented or described above, but it can be modified within the basic idea according to the need present at each time. Thus it is possible e.g. to apply in the drilling head of the drilling unit a greater number of frame parts, than presented above, whereby e.g. the drilling bits may be connected to the head of the first frame part with an integrated cutting block. Naturally it is not necessary to use a casing shoe existing in the embodiment shown particularly in the enclosed drawings, but the same kind assemblies may be constructed by solid assemblies that are placed in the inside and/or outside surfaces of the head of the casing part. Correspondingly the casing shoe in question may be constructed in a way allowing its twisting movement with respect to the second frame part and at least partially limiting the mutual longitudinal movement of the same in such a way that the casing shoe rests on a guiding surface of the second frame part that reaches inside the casing part, whereby the second frame part further rests indirectly on a guiding projection of the first frame part.

Naturally the mutual counterpart assemblies between the drilling means may be constructed in most differing ways. Thus the first frame part and the second frame part may be connected to each other by e.g. a thread joint, wherein the locking between the same is achieved by mechanical, pressurized fluid and/or electrical assemblies. Naturally the parts may be connected to each other only by a thread joint, which solution, however, may cause problems in separating the parts from each other, because the parts will probably jam against each other too tightly during drilling. The frame parts may be connected by the quick coupling principle also in a way that there are teeth in both parts which fit to each other in the longitudinal direction. In such a case it is, however, not possible with simple arrangements to achieve the actual longitudinal locking between the frame parts. Then there is e.g. the risk that in certain operational situations the frame part separates unintentionally, whereby additional installation stages are needed to couple them again. With the solution in question, there is not a full certainty in every operational situation about the frame parts being tightened to each other long enough, in which case on the other hand the drilling result suffers because the center drill does not reach far enough to drill, and on the other hand the toothing between the frame parts may get out of order by breakage.

Naturally the second drilling means may be connected only to the first drilling means, in which case there is a risk that the second drilling means turns into an unsuitable position at the bottom of the hole, when the first drilling means is removed from the hole, and thus possibly even prevent exploitation of the hole being drilled. In the drilling apparatus according to the invention, parts made or customary materials may be used that are produced applying most differing manufacturing methods. In addition e.g. an oscillating movement may be applied as the drilling movement of the drilling apparatus.

The invention claimed is:

1. A drilling apparatus, comprising:

a casing part;

a first drilling element operative to drill a center hole and at least partially arranged within the casing part;

a second drilling head element operative to ream the center hole;

a removable power transmitting arrangement operative to couple the first drilling head element and the second drilling head element at least during drilling;

a first frame part in which the first drilling head element is arranged;

a second frame part in which the second drilling head element is arranged; and a flushing flow arrangement operative to flush waste, being generated by drilling, inside the case part, the flushing flow arrangement comprising a first transferring arrangement operative to transfer flushing medium centrally through the first drilling head element and then toward an outer periphery of the first drilling head element, the flushing flow arrangement further comprising a second transferring arrangement operative to carry out a reverse circulation of flushing medium from an outer periphery of the first drilling head element toward a central portion of a drilling surface of the first drilling head element and then internally through the first drilling head element toward a periphery of the first drilling head element into a space between the first frame part and the casing part.

2. The drilling apparatus according to claim 1, wherein the casing part is arranged to be drawn into the hole to be drilled by means of the first and of the second drilling head element.

3. The drilling apparatus according to claim 1, further comprising:

the first transferring arrangement is arranged within the first frame part.

4. The drilling apparatus according to claim 1, further comprising:

a passing flow duct operative to direct flushing flow centrally from the first transferring arrangement peripherally to the space between the first frame part and the casing part.

5. The drilling apparatus according to claim 4, wherein the passing flow duct is operative to adjust a return flow taking place from the drilling surface.

6. The drilling apparatus according to claim 5, wherein the return flow comprises sampling flow.

7. The drilling apparatus according to claim 4, wherein flow in the passing flow duct is adjusted with a throttle control.

8. The drilling apparatus according to claim 1, wherein the flushing flow arrangement is operative to feed flushing medium for the drilling and for removal of drilling waste generated inside the casing part.

9. The drilling apparatus according to claim 1, wherein the removable power transmitting arrangement comprises a bayonet coupling.

10. A drilling method carried out by a drilling apparatus comprising a first drilling element operative to drill a center hole, a second drilling head element operative to ream the center hole, the drilling method comprising:

transferring a flushing medium centrally through a first drilling head element;

transferring the flushing medium toward an outer periphery of the first drilling head element;

carrying out a reverse circulation of the flushing medium from an outer periphery of the first drilling head element toward a central portion of a drilling surface of the first drilling head element; and transferring the flushing medium internally through the first drilling head element toward a periphery of the first drilling head element into a space between the first frame part and the casing part.

11. The method according to claim 10, further comprising:

feeding of flushing medium for drilling; and removing drilling waste generated by the drilling.

12. The method according to claim 10, further comprising:

wherein the return flow comprises sampling flow.

13. The method according to claim 10, further comprising:

directing the flushing medium by a passing flow duct to the space between the first frame part and the casing part, wherein a portion of the flushing flow is directed into the flow duct.

14. The method according to claim 10, further comprising:

adjusting a return flow.

15. The method according to claim 10, further comprising:

adjusting a flow of flushing medium by directing the flushing medium by a passing flow duct to the space between the first frame part and the casing part.

16. The method according to claim 15, further comprising:

adjusting a flow of flushing medium occurring in the passing flow duct with a throttle control.

* * * * *